US006161974A

United States Patent [19]

Nakagawa

[11] Patent Number: 6,161,974

[45] Date of Patent: Dec. 19, 2000

[54] WRITING INSTRUMENT

[75] Inventor: Satoshi Nakagawa, Tokyo, Japan

[73] Assignees: Morito Co., Ltd., Tokyo, Japan; Kane-M, Inc., East Rutherford, N.J.

[21] Appl. No.: 09/432,922

[22] Filed: Nov. 2, 1999

[30] Foreign Application Priority Data

Jul. 8, 1999 [JP] Japan ..... 11-194659

[51] Int. Cl.[7] ..... A46B 5/02

[52] U.S. Cl. ..... 401/6; 401/8; D19/41

[58] Field of Search ..... 401/6, 7, 8; D19/41, D19/42, 44

[56] References Cited

U.S. PATENT DOCUMENTS

| | | | |
|---|---|---|---|
| D. 246,904 | 1/1978 | MacIntosh | D19/41 |
| D. 253,416 | 11/1979 | MacIntosh | D19/41 |
| D. 333,837 | 3/1993 | Peersmann | 401/6 |
| 967,410 | 8/1910 | Montgomery | 401/6 |
| 3,947,977 | 4/1976 | Bishop | 401/6 |
| 5,405,206 | 4/1995 | Bedol | 401/8 |
| 5,971,642 | 10/1999 | O'Mara et al. | 401/6 |

FOREIGN PATENT DOCUMENTS

| | | | |
|---|---|---|---|
| 93/13949 | 7/1993 | WIPO | 401/6 |

*Primary Examiner*—Charles R. Eloshway
*Attorney, Agent, or Firm*—O'Melveny & Myers LLP

[57] ABSTRACT

A writing instrument comprises a gripping component formed in the shape of a tab. An insertion component is formed in an annular shape and provided to the lower surface of one end of the gripping component. A pen tip component is provided extending from one end of the gripping component and having at the distal end thereof a pen tip capable of writing.

16 Claims, 7 Drawing Sheets

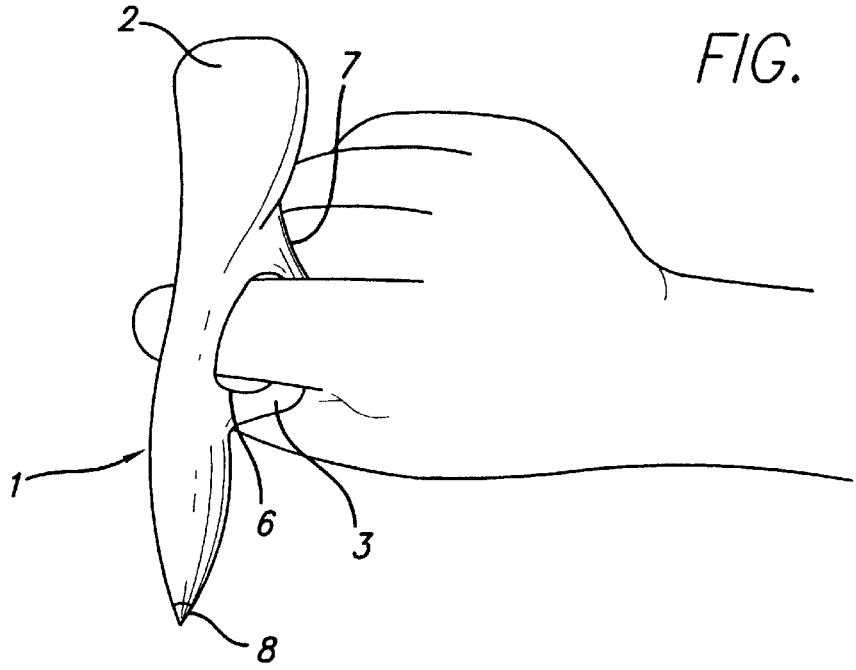
FIG. 13
FIG. 14
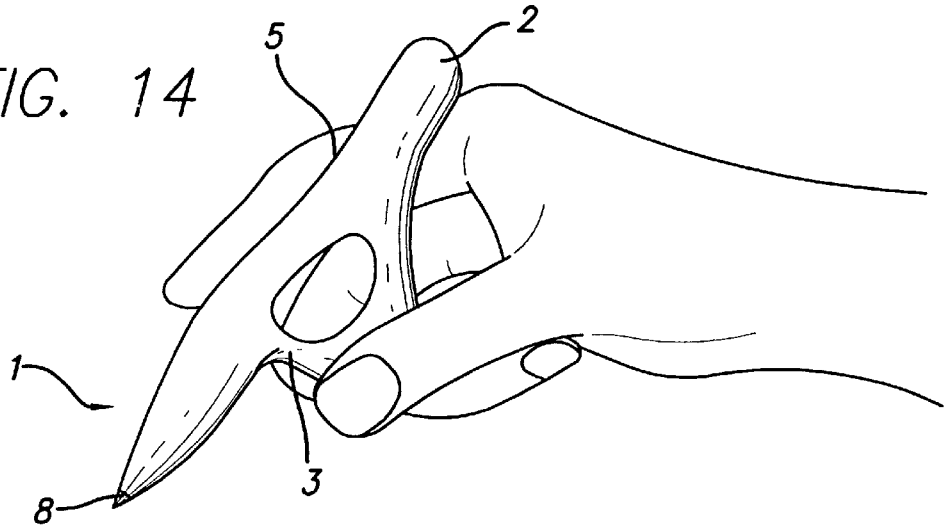

WRITING INSTRUMENT

BACKGROUND OF THE INVENTION

1. Field of the Invention

The present invention relates to a writing instrument such as a ball-point pen, a mechanical pencil, or a fountain pen, and more particularly relates to a writing instrument which can be advantageously used by people who are unable to move their fingers freely.

2. Description of Related Art

Writing instruments that are in general use have a cylindrical body, and are designed so that this cylindrical body is held by three fingers, namely, the thumb, indent finger, and middle finger. However, because the overall shape of the above-mentioned conventional writing instruments is cylindrical, when they are held, considerable grip strength is required between the thumb and the index finger or the middle finger. Accordingly, if a person such as a person with some disability or injury to the fingers cannot move his or her fingers freely, there is a decrease in the above-mentioned grip strength, so there is not enough force to press the pen tip against the paper, and the writing instrument slips up through the fingers and is difficult to use.

In view of this, in order to solve the above problems, it is an object of the present device to provide a writing instrument which can be held easily, even if the fingers cannot be moved freely, and with which writing can be performed easily.

SUMMARY OF THE INVENTION

To achieve the stated object, a first embodiment of a writing instrument comprises a gripping component formed in the shape of a tab. An insertion component is formed in an annular shape and provided to the lower surface of one end of the gripping component. A pen tip component is provided extending from one end of the gripping component and having at the distal end thereof a pen tip capable of writing.

A second embodiment of a writing instrument comprises a gripping component formed in the shape of a fan tab and having a concave surface on its upper surface. An insertion component is formed in an annular shape and provided to the lower surface of the narrower end of the fan shape of the gripping component with the outer peripheral portion integrated such that a hole is made in the width direction of the gripping component. The insertion component is continuous via a concave component curving from the rest of the outer peripheral portion toward the lower surface of the wider end of the fan shape of the gripping component. A pen tip component is integrally provided so as to extend from one end of the gripping component, having at the distal end thereof a pen tip capable of writing, and being continuous via a concave component curving from the outer peripheral portion of the insertion component toward the pen tip.

A more complete understanding of the writing instrument will be afforded to those skilled in the art, as well as a realization of additional advantages and objects thereof, by a consideration of the following detailed description of the preferred embodiment. Reference will be made to the appended sheets of drawings which will first be described briefly.

BRIEF DESCRIPTION OF THE DRAWINGS

FIG. 13 is an oblique view illustrating a usage example of the above-mentioned writing instrument; and FIG. 14 is an oblique view illustrating a usage example of the above-mentioned writing instrument.

DETAILED DESCRIPTION OF THE PREFERRED EMBODIMENT

The present invention satisfies the need for a writing instrument which can be held easily, even if the fingers cannot be moved freely, and with which writing can be performed easily. In the detailed description that follows, like element numerals are used to describe like elements shown in one or more of the figures.

Figure 1:
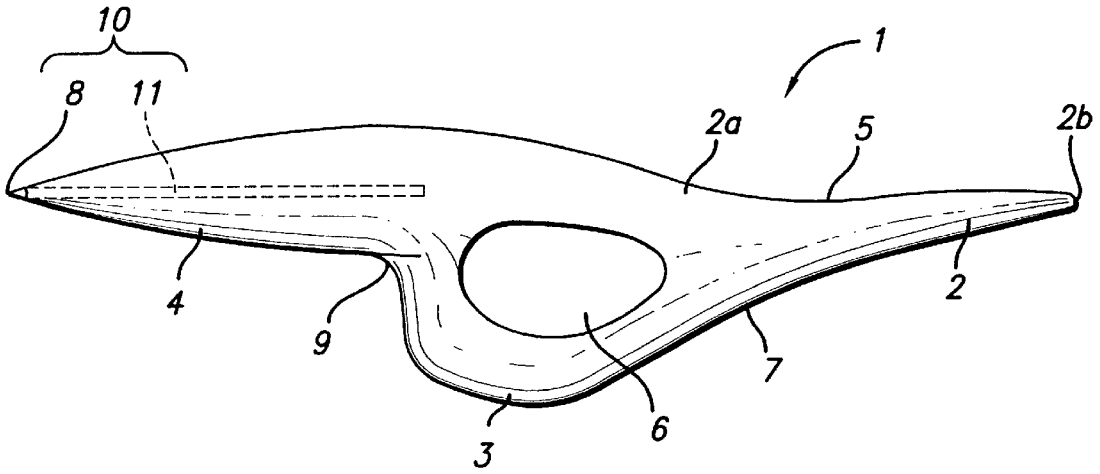
FIG. 1 is a front view illustrating an embodiment of the writing instrument of the present invention.
Figure 2:
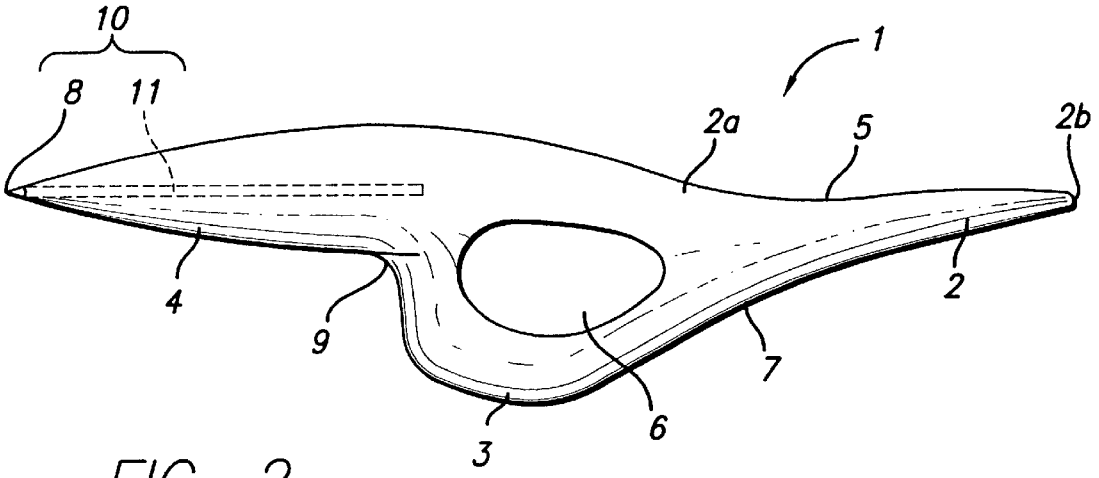
FIG. 2 is a side view of the writing instrument of FIG. 1.
Figure 3:
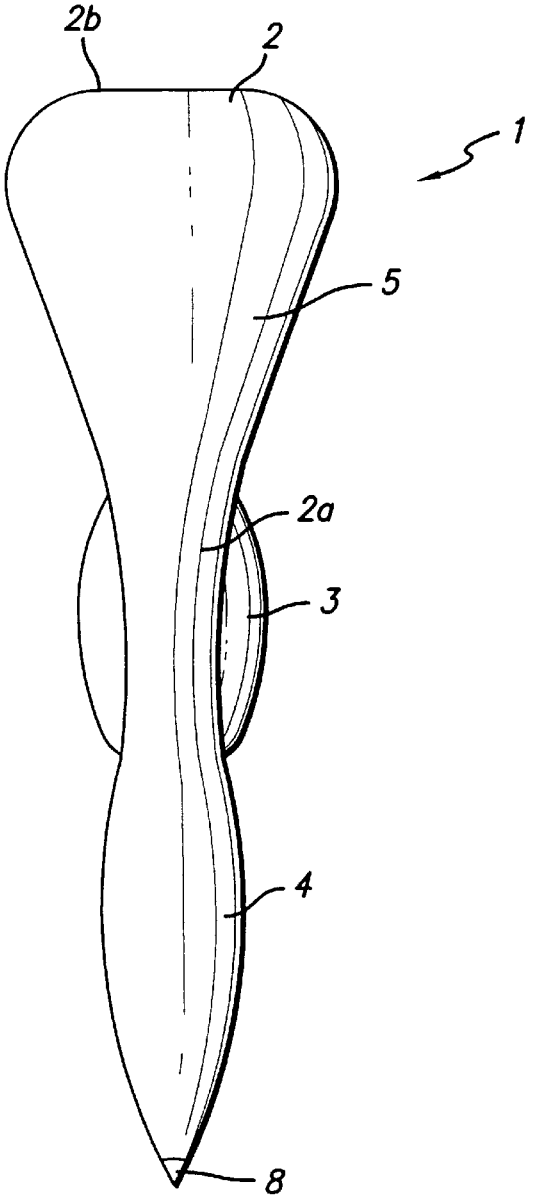
FIG. 3 is a plan view of the writing instrument.
Figure 4:
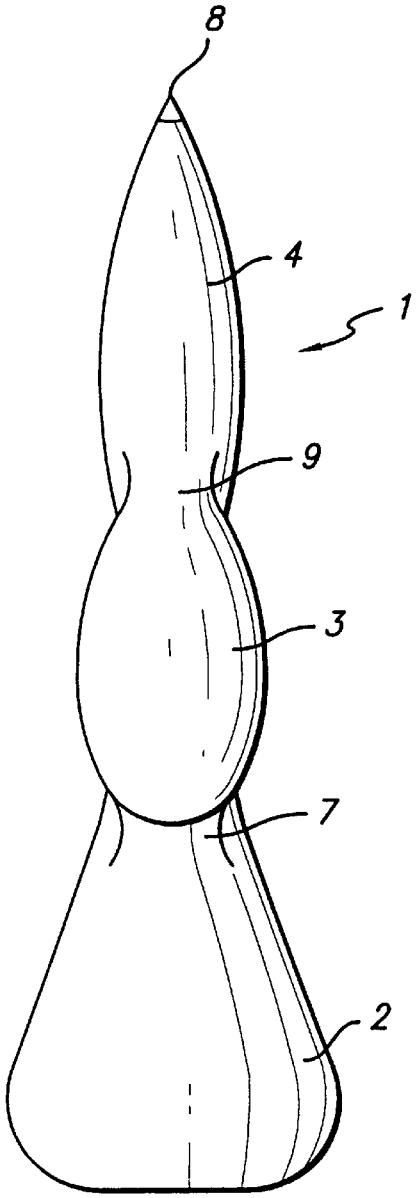
FIG. 4 is a bottom view of the writing instrument.
Figure 5:
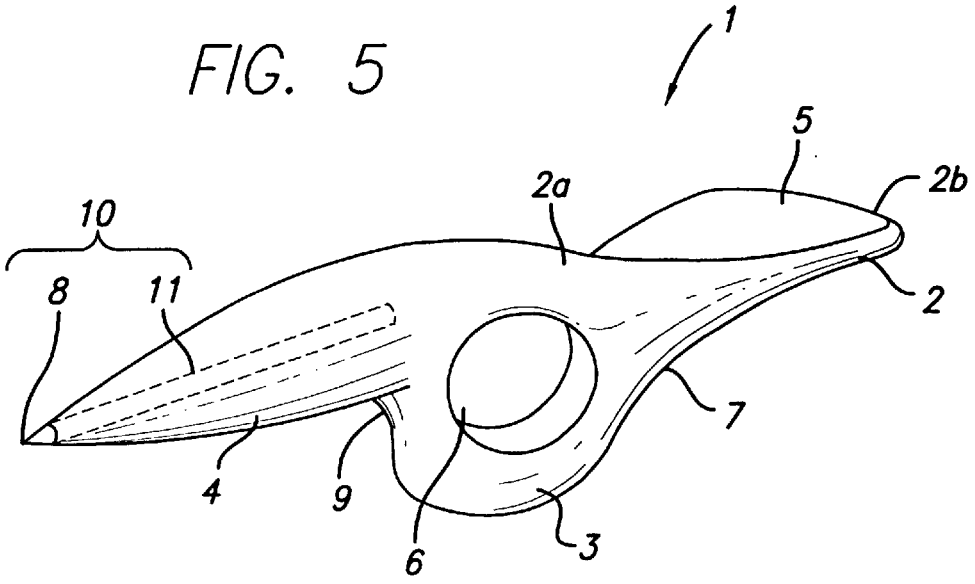
FIG. 5 is an oblique view of the writing instrument.

As shown in FIGS. 1 to 3, a writing instrument 1 comprises a gripping component 2, an insertion component 3, and a pen tip component 4. The gripping component 2 is formed as a tab in the shape of a fan. This gripping component 2 has a concave surface 5 which curves smoothly inward on the tab-shaped top surface. The insertion component 3 is formed in an annular shape so that a finger can be passed therethrough. Part of the outer peripheral portion of this insertion component 3 is integrally provided on the lower surface of the narrower end 2*a* of the fan shape of the gripping component 2 such that a hole 6 is made in the width direction of the gripping component 2, i.e., transverse to the length direction of component 2. This gripping component 2 is formed so as to be continuous via a concave component 7 curving smoothly from the rest of the outer peripheral portion toward the lower surface of the wider end 2*b* of the fan shape of the gripping component 2.

The pen tip component pen tip component 4 is integrally provided so as to extend from one end 2*a* of the gripping component 2. This pen tip component 4 has a pen tip 8 capable of writing at the distal end extending from the gripping component 2. Also, the pen tip component 4 is continuous via a concave component 9 curving smoothly from the outer peripheral portion of the insertion component 3 toward the pen tip 8.

The pen tip 8 is a pen tip of a writing means 10 such as ball-point pen, a mechanical pencil, or a fountain pen. This writing means 10 has a core member 11 that holds ink, pencil lead, or the like, and this core member 11 is held internally from the pen tip component 4 toward the other end 2*a* of the gripping component 2. This writing means 10 comprising the pen tip 8 and the core member 11 is suitably attached by fitting or threading to the pen tip component 4, and the replacement of the ink, pencil lead, or the like is accomplished by reversing the above-mentioned fitting or threading.

Figure 6:
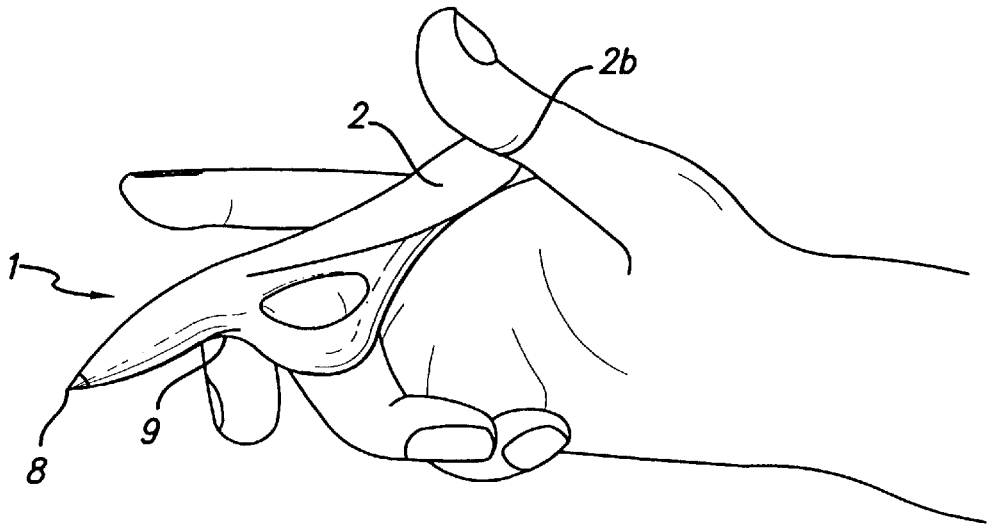
FIG. 6 is an oblique view illustrating a usage example of the above-mentioned writing instrument.

An embodiment in which a writing instrument structured as above is used will now be described. First, the usage example shown in FIG. 6 is an embodiment in which the concave component 9 is placed on the middle finger, and the other end 2*b* of the gripping component 2 is pressed and held by the thumb. In this state, writing is performed by leaving the hand resting on a desk and pressing the pen tip 8 against a sheet of paper or the like. With the usage example shown in FIG. 6, adequate holding force can be obtained and writing can be performed smoothly even if the index finger is disabled.

Figure 7:
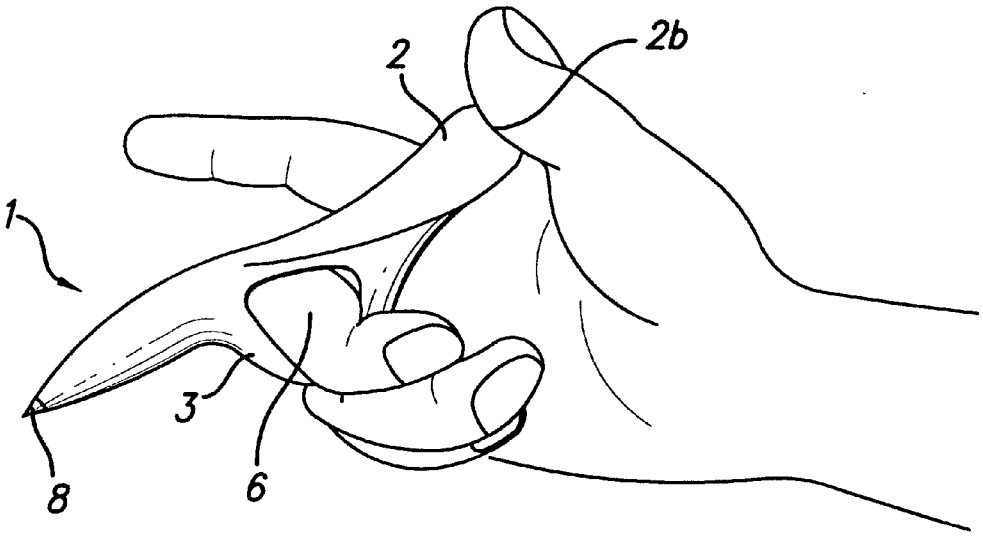
FIG. 7 is an oblique view illustrating a usage example of the above-mentioned writing instrument.

Next, the usage example shown in FIG. 7 is an embodiment in which the middle finger is passed through the hole 6 in the insertion component 3, and the other end 2*b* of the gripping component 2 is held down with the thumb. In this state, writing is performed by leaving the hand resting on a desk and pressing the pen tip 8 against a sheet of paper or the like. With the usage example shown in FIG. 7, the middle finger is passed through the hole 6 in the insertion component 3, which allows adequate holding force to be obtained and writing to be performed smoothly even if the index finger is disabled. Also, the holding force is greater with the usage example shown in FIG. 7 than with the usage example shown in FIG. 6. The usage example shown in FIG. 7 is an example in which the middle finger is passed through the hole 6 in the insertion component 3, but as a variation on this example, it is also possible for the index finger, ring finger, or little finger to be passed through the hole 6 in the insertion component 3, although this is not shown in the figure.

Figure 8:
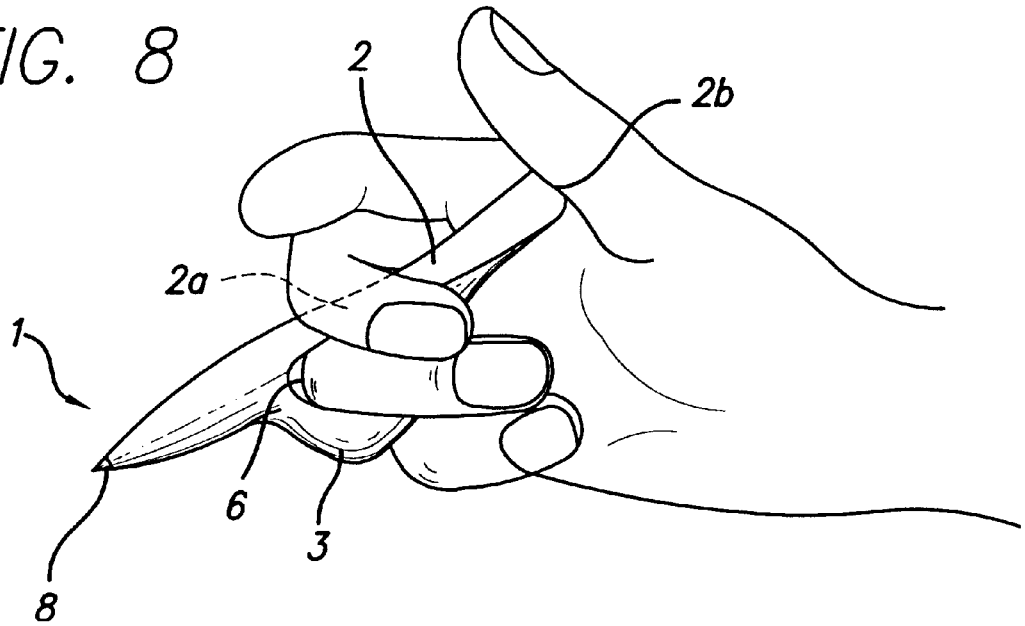
FIG. 8 is an oblique view illustrating a usage example of the above-mentioned writing instrument.

Next, the usage example shown in FIG. 8 is an embodiment in which the ring finger is passed through the hole 6 in the insertion component 3, the area around the end 2*a* of the gripping component 2 or the outer peripheral portion of the insertion component 3 or is held down with a finger next to the ring finger (the middle finger or little finger), and the other end 2*b* of the gripping component 2 is held down with the thumb. In this state, writing is performed by leaving the hand resting on a desk and pressing the pen tip 8 against a sheet of paper or the like. With the usage example shown in FIG. 8, the ring finger is passed through the hole 6 in the insertion component 3, which allows adequate holding force to be obtained and writing to be performed smoothly even if the index finger or middle finger is disabled. Also, since the outer peripheral portion of the insertion component 3 or the area around the end 2*a* of the gripping component 2 is held down with a finger next to the ring finger, the holding force is greater with the usage example shown in FIG. 8 than with the usage example shown in FIG. 7.

The usage example shown in FIG. 8 is an example in which the ring finger is passed through the hole 6 in the insertion component 3, but as a variation on this example, it is also possible for the index finger, middle finger, or little finger to be passed through the hole 6 in the insertion component 3, although this is not shown in the figure. In this case the outer peripheral portion of the insertion component 3 or the area around the end 2*a* of the gripping component 2 is held down with a finger next to the finger passed through the hole.

Figure 9:
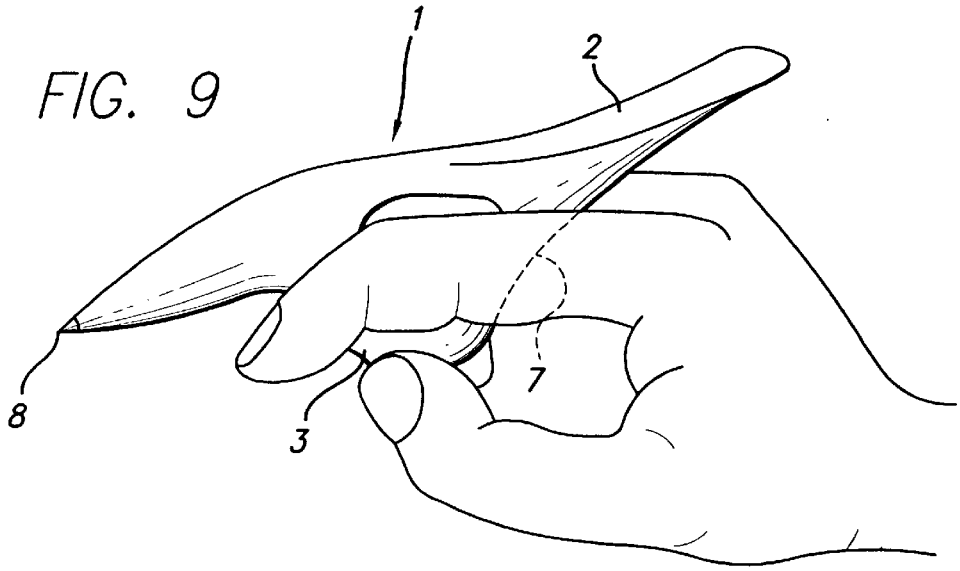
FIG. 9 is an oblique view illustrating a usage example of the above-mentioned writing instrument.

Next, the usage example shown in FIG. 9 is an embodiment in which the insertion component 3 is sandwiched between the index finger and the middle finger. In this state, writing is performed by leaving the hand resting on a desk and pressing the pen tip 8 against a sheet of paper or the like. With the usage example shown in FIG. 9, the insertion component 3 is sandwiched between the index finger and the middle finger, and the lower surface (the concave component 7) of the gripping component 2 is placed at the base of the sandwiching fingers, which allows adequate holding force to be obtained and writing to be performed smoothly even if the thumb is disabled. The usage example shown in FIG. 9 is an example in which the insertion component 3 is sandwiched between the index finger and the middle finger, but as a variation on this example, it is also possible for the insertion component 3 to be sandwiched between the middle finger and the ring finger, or between the ring finger and the little finger, although this is not shown in the figure.

Figure 10:
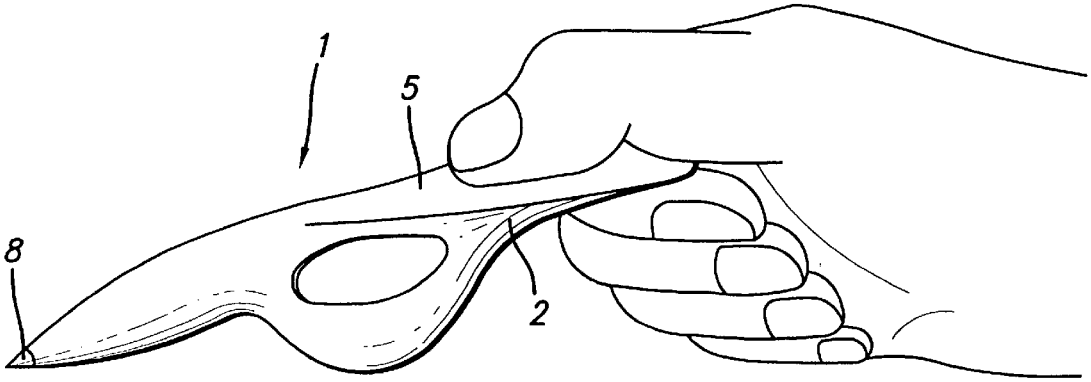
FIG. 10 is an oblique view illustrating a usage example of the above-mentioned writing instrument.

Next, the usage example shown in FIG. 10 is an embodiment in which the gripping component 2 is sandwiched between the thumb and the index finger. In this case, the pad of the thumb rests on the concave surface 5 on the top of the gripping component 2, providing a secure grip. In this state, writing is performed by leaving the hand resting on a desk and pressing the pen tip 8 against a sheet of paper or the like. With the usage example shown in FIG. 10, the gripping component 2 is gripped between the thumb and the index finger, with the thumb resting on the concave surface 5 on the top of the gripping component 2, which allows adequate holding force to be obtained and writing to be performed smoothly even if the middle finger is disabled. The usage example shown in FIG. 10 is an example in which the gripping component 2 is sandwiched between the thumb and the index finger, but as a variation on this example, it is also possible for the gripping component 2 to be sandwiched between the thumb and the middle finger, although this is not shown in the figure.

Figure 11:
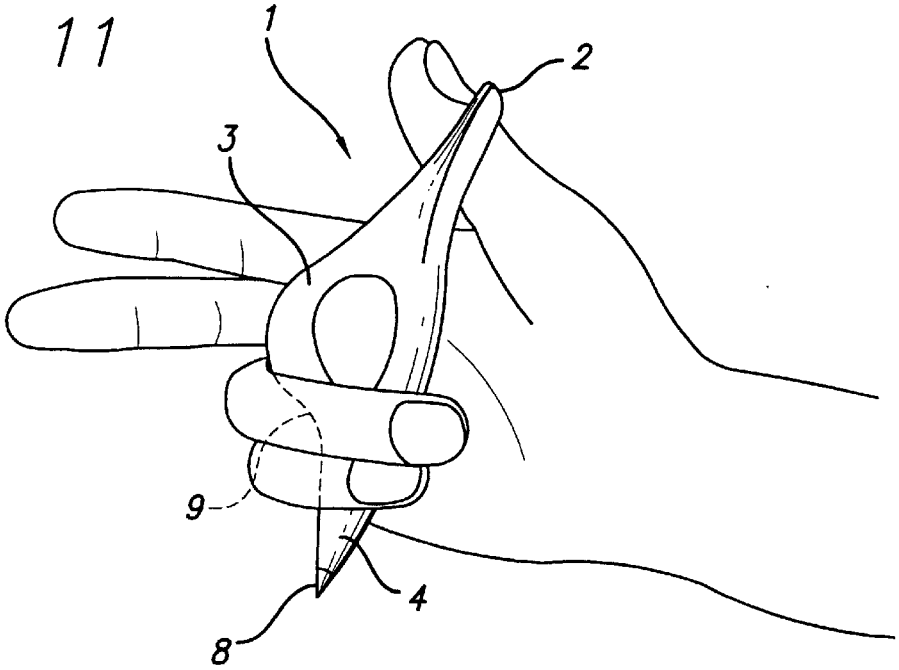
FIG. 11 is an oblique view illustrating a usage example of the above-mentioned writing instrument.

Next, the usage example shown in FIG. 11 is an embodiment in which the writing instrument 1 is laid across the palm, the ring finger and little finger are curled inward so as to grip the insertion component 3 and the pen tip component 4 from the concave component 9 side, and the side of the gripping component 2 is sandwiched by the side of the thumb. In this state, writing is performed by leaving the hand resting on a desk and pressing the pen tip 8 against a sheet of paper or the like. With the usage example shown in FIG. 11, the insertion component 3 and the pen tip component 4 are gripped with the ring finger and the little finger, and the side of the gripping component 2 is supported by the thumb, which allows adequate holding force to be obtained and writing to be performed smoothly even if the index finger, the middle finger and the thumb are disabled. The usage example shown in FIG. 11 is an example in which the insertion component 3 and the pen tip component 4 are gripped by the ring finger and the little finger, but as a variation on this example, it is also possible for the insertion component 3 and the pen tip component 4 to be gripped by the ring finger and the middle finger, although this is not shown in the figure.

Figure 12:
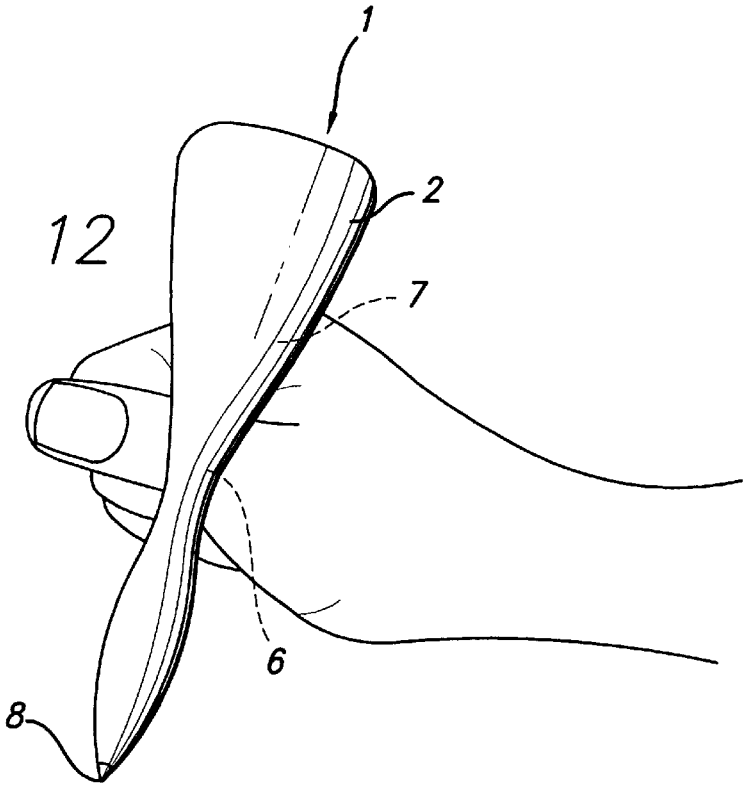
FIG. 12 is an oblique view illustrating a usage example of the above-mentioned writing instrument.

Next, the usage example shown in FIG. 12 is an embodiment in which the thumb is passed through the hole 6 in the insertion component 3, and the lower surface (the concave component 7) of the gripping component 2 is rested against the knuckle of the index finger. In this state, writing is performed by leaving the hand resting on a desk and pressing the pen tip 8 against a sheet of paper or the like. With the usage example shown in FIG. 12, the thumb is passed through the hole 6 in the insertion component 3, and the lower surface (the concave component 7) of the gripping component 2 is rested against the knuckle of the index finger, which allows adequate holding force to be obtained and writing to be performed smoothly even if the index finger, the middle finger and the thumb are disabled.

Next, the usage example shown in FIG. 13 is an embodiment in which the index finger is passed through the hole 6 in the insertion component 3, and the lower surface (the concave component 7) of the gripping component 2 is rested against the knuckle of the middle finger. In this state, writing is performed by leaving the hand resting on a desk and pressing the pen tip 8 against a sheet of paper or the like. With the usage example shown in FIG. 13, the index finger is passed through the hole 6 in the insertion component 3, and the lower surface (the concave component 7) of the gripping component 2 is rested against the knuckle of the middle finger, which allows adequate holding force to be obtained and writing to be performed smoothly even if the index finger, the middle finger and the thumb are disabled. The usage example shown in FIG. 13 is an example in which the index finger is passed through the insertion component 3, but as a variation on this example, it is also possible for the middle finger, the ring finger, or the little finger to be passed through the hole 6 in the insertion component 3, or if needed, for the wrist to be turned over so that the thumb is on top, although this is not shown in the figure.

Next, the usage example shown in FIG. 14 is an embodiment in which the writing instrument 1 is turned sideways, the index finger is placed along the concave surface 5 on the top of the gripping component 2, the thumb is placed along the outer peripheral portion of the insertion component 3, and the writing instrument 1 is sandwiched between the index finger and the thumb. In this state, writing is performed by leaving the hand resting on a desk and pressing the pen tip 8 against a sheet of paper or the like. With the usage example shown in FIG. 14, the writing instrument is sandwiched between the thumb and the index finger, and is held down by the index finger lying along the concave surface 5 on the top of the gripping component 2, which allows adequate holding force to be obtained and writing to be performed smoothly even if the middle finger is disabled.

Therefore, the writing instrument structured in this manner can be used in various ways as illustrated in the usage examples of FIGS. 6 to 14, which means that it can be suitably held and used for writing even by people whose fingers cannot be moved freely, such as those with some disability or injury to the fingers. In a special example, even people without some of their fingers will be able to write without hindrance if one of the above embodiments is employed. This device can also be used with ease by children who are still too young to hold a conventional cylindrical writing instrument properly. Thus, the above-mentioned writing instrument can be advantageously utilized by people who cannot use a conventional cylindrical writing instrument properly, and it permits them to write with ease things that they could not write as desired before.

Also, with the various usage forms described above, not only can a person write with ease, but the present invention can also be used for the purpose of restoring function to the fingers as rehabilitation for disabled fingers. When the writing instrument is held such that the end 2*b* of the gripping component 2 rests in the palm or at the base between fingers, the gripping component 2 serves to stimulate the various nerves it touches, and this also helps in the above-mentioned rehabilitation. Accordingly, it is preferable for the gripping component 2 to be formed in a fan shape as mentioned above. Furthermore, because the writing instrument in the above embodiments is molded symmetrically to the right and left, it can be used regardless of whether the user is right- or left-handed. Consequently, while the usage examples illustrated in FIGS. 6 to 14 are examples of use on the right hand, use is similarly possible on the left hand. Also, in the above embodiments, the description is of passing just one finger through the insertion component 3, but it is also conceivable that two fingers, for example, could be passed through the insertion component 3. Thus, the above-mentioned writing instrument can be used not only as in the usage examples of FIGS. 6 to 14, but also in various other ways as desired by the user.

As described above, the writing instrument of the present invention has a structure comprising a gripping component formed in the shape of a tab, an insertion component formed in an annular shape and provided to the lower surface of one end of the gripping component, and a pen tip component provided extending from one end of the gripping component and having at the distal end thereof a pen tip capable of writing, so it is possible to obtain a writing instrument that can be suitably held in a variety of configurations by gripping the gripping component with the fingers or by passing various fingers through the insertion component. Accordingly, this writing instrument can be suitably held and easily used for writing even by people who cannot move their fingers freely or cannot use a conventional cylindrical writing instrument properly. Also, with the various usage forms described above, not only can a person write with ease, but the present invention can also be used for the purpose of restoring function to the fingers as rehabilitation for disabled fingers. Also, because concave component is provided to the upper surface of the gripping component, and because the lower surface of the gripping component and the outer peripheral portion of the insertion component are formed continuously by a concave component, and because the outer peripheral portion of the insertion component and the pen tip component are also formed continuously by a concave component, the portions touched by the fingers are formed smoothly, making the instrument easier to hold during its use. The gripping component serves to stimulate the various nerves it touches when the other end of the gripping component is in contact with the palm or at the base between fingers, and this is favorable for rehabilitation. Accordingly, it is preferable for the gripping component to be formed in a fan shape.

Having thus described a preferred embodiment of a writing instrument, it should be apparent to those skilled in the art that certain advantages of the aforementioned device have been achieved. It should also be appreciated that various modifications, adaptations, and alternative embodiments thereof may be made within the scope and spirit of the present invention. The invention is further defined by the following claims.

What is claimed is:

1. A writing instrument, comprising:

a gripping component formed in the shape of a tab, said griping component having a proximal end and a distal end;

an insertion component extending from said gripping component and having an outer peripheral portion integrally formed with a lower surface of said proximal end of said gripping component, said outer peripheral portion defining a hole that is transverse to said gripping component; and a writing tip component coextensive with said proximal end of said gripping component, said writing tip component having a distal end, and having at said distal end of said writing tip component a tip adapted for writing, wherein said insertion component extends from a lower surface of said writing tip component and is located substantially below the level of said lower surface in use.

2. The writing instrument of claim 1, wherein said distal end of said gripping component is wider than said proximal end, thereby defining a fan shape on an upper portion of said gripping component.

3. The writing instrument of claim 2, wherein said peripheral portion of said insertion component is narrower than said upper portion of said gripping component at said distal end thereof.

4. The writing instrument of claim 1, wherein said hole defined by said peripheral portion of said insertion component is adapted for insertion of at least one finger of a user holding said writing instrument, wherein said at least one finger is inserted in a direction transverse to, and remaining on a same side of, both of said gripping component and said writing tip component.

5. The writing instrument of claim 1, wherein said insertion component is configured for being sandwiched between a first finger and a second finger of a user holding said writing instrument, wherein neither of said first finger and said second finger are inserted through said hole, and wherein said first finger and said second finger are substantially parallel to each other and are both on a same side of said gripping component and said writing tip component.

6. The writing instrument of claim 1, wherein said outer peripheral portion of said insertion component is provided with a narrowed neck in a medial portion, said medial portion being defined between said lower surface of said gripping component and a bulbous lower portion of said outer peripheral portion.

7. The writing instrument of claim 1, wherein said writing instrument is formed symmetrically to the right and to the left, thereby defining a plane of right-left symmetry.

8. The writing instrument of claim 7, wherein said hole in said insertion component is transverse to said plane of right-left symmetry.

9. The writing instrument of claim 7, wherein said hole in said insertion component is perpendicular to said plane of right-left symmetry.

10. A writing instrument, comprising:

a gripping component formed in the shape of a fan tab and having a distal end and a narrow end, wherein said distal end is wider than said narrow end, and having a concave upper surface;

an insertion component integrally formed with a lower surface of said narrow end of said gripping component, having an outer peripheral portion thereof integrated such that a hole is provided transverse to said gripping component, said insertion component being continuous via a concave component curving from said outer peripheral portion toward a lower surface of said distal end of said gripping component; and a writing tip component integrally provided so as to extend from said narrow end of said gripping component, said writing tip component having a distal end, and having at said distal end of said writing tip component a tip adapted for writing, wherein said distal end of said writing tip component is continuous via a concave component curving from said outer peripheral portion of said insertion component toward said distal end of said writing tip component, and wherein said insertion component extends from a lower surface of said writing tip component and is located substantially below the level of said lower surface in use.

11. The writing instrument of claim 10, wherein said hole in said insertion component is adapted for insertion of at least one finger of a user holding said writing instrument, wherein said at least one finger is inserted in a direction transverse to, and remaining on a same side of, both of said gripping component and said writing tip component.

12. The writing instrument of claim 10, wherein said insertion component is configured for being sandwiched between a first finger and a second finger of a user holding said writing instrument, wherein neither of said first finger and said second finger are inserted through said hole, and wherein said first finger and said second finger are substantially parallel to each other and are both on a same side of said gripping component and said writing tip component.

13. The writing instrument of claim 10, wherein said writing instrument is formed symmetrically to the right and to the left, thereby defining a plane of right-left symmetry.

14. The writing instrument of claim 13, wherein said hole in said insertion component is transverse to said plane of right-left symmetry.

15. The writing instrument of claim 13, wherein said hole in said insertion component is perpendicular to said plane of right-left symmetry.

16. A method of writing with a writing instrument comprising a gripping component formed in the shape of a tab, said gripping component having a proximal end and a distal end, an insertion component extending from said gripping component, having an outer peripheral portion integrally formed with a lower surface of said proximal end of said gripping component, said outer peripheral portion defining a hole, and a writing tip component coextensive with said proximal end of said gripping component, said writing tip component having a distal end, and having at said distal end of said writing tip component a tip adapted for writing, wherein said insertion component extends from a lower surface of said writing tip component and is located substantially below the level of said lower surface in use. said method comprising:

holding said writing instrument by passing a finger of a user's hand through said hole, and holding down said distal end of said gripping component with the thumb of said user's hand; and pressing said tip against a writing surface.

* * * * *